United States Patent [19]

Talpo

[11] Patent Number: 4,628,164

[45] Date of Patent: Dec. 9, 1986

[54] ARC CONTACT SYSTEM FOR ELECTRICAL CIRCUIT BREAKERS, IN PARTICULAR OF THE TYPE USING AN ARC EXTINGUISHING FLUID

[75] Inventor: Gianpietro Talpo, Bergamo, Italy

[73] Assignee: SACE S.p.A. Costruzioni Elettromeccaniche, Bergamo, Italy

[21] Appl. No.: 696,524

[22] Filed: Jan. 30, 1985

[30] Foreign Application Priority Data

Feb. 10, 1984 [IT] Italy ..... 20810/84[U]

[51] Int. Cl.[4] ..... H01H 33/88

[52] U.S. Cl. ..... 200/148 A; 200/258

[58] Field of Search ..... 200/148 A, 258, 51.08, 200/51.13

[56] References Cited

U.S. PATENT DOCUMENTS 1,271,980 7/1918 Wright ..... 200/51.08

1,531,917 3/1925 French ..... 200/258

1,966,234 7/1934 Cox et al. ..... 200/258

4,046,978 9/1977 Badon ..... 200/148 A 4,467,158 8/1984 Kobayashi et al. ..... 200/148 A

*Primary Examiner*—Robert S. Macon

*Attorney, Agent, or Firm*—Diller, Ramik & Wight

[57] ABSTRACT

In an arc contact system for electrical circuit breakers, in particular of the type using an arc extinguishing fluid, comprising a stationary contact and a movable contact, one of the two arc contacts is formed by a tubular cylindrical body bearing a hollow sleeve of arc resistant material at its end destined to cooperate with the other arc contact; and the other arc contact is formed by a substantial cylindrical rod provided with at least one central longitudinal cut, suitable to render elastically yielding in the radial direction said rod, destined to be inserted inside the tubular cylindrical body of said first arc contact.

11 Claims, 4 Drawing Figures

Figure 1:
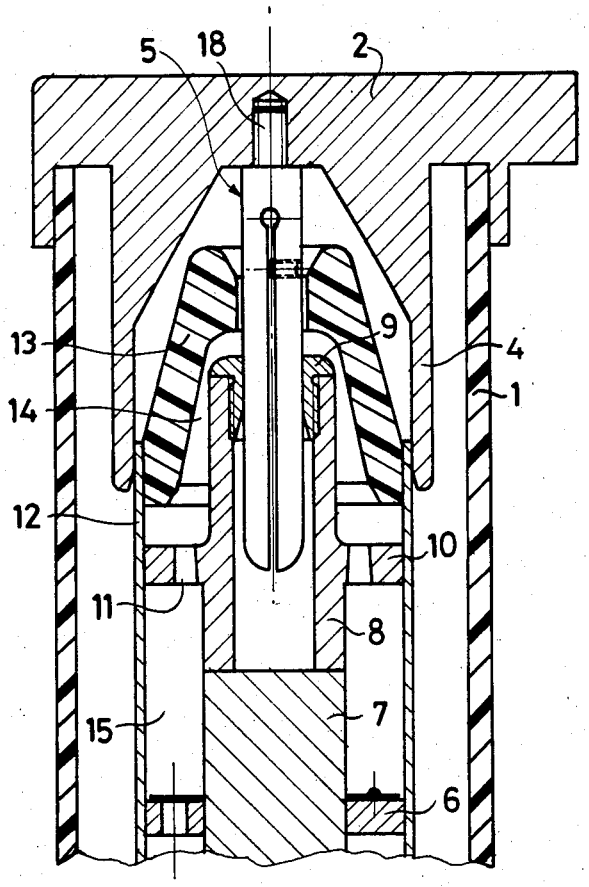

ARC CONTACT SYSTEM FOR ELECTRICAL CIRCUIT BREAKERS, IN PARTICULAR OF THE TYPE USING AN ARC EXTINGUISHING FLUID

The present invention relates to a system of arc contacts, comprising a stationary arc contact and a movable arc contact, for electrical circuit breakers, in particular of the type using an arc quenching fluid, such as sulphur hexafluoride, compressed by means of a piston during the movable contact opening stroke.

It is known that in this type of electrical circuit breakers, the creation of turbulence areas along the path of the extinguishing gas produces many advantages to the purpose of the arc quenching. It has been proposed therefore, to provide, in the inside of a channel formed around the arc contact system, and through which the extinguishing gas flows, suitable inserts whose function is of creating a turbulent stream, so as to improve the mixing of the gas heated by the arc with the fresh extinguishing gas, to the purpose of rapidly eliminating from the region of the arc the particles electrically charged, and promote thus the extinguishing of the arc. These inserts may consist, according to the technique known, of annular bodies supported by the stationary arc contact and/or by the nozzle body of insulating material surrounding said stationary arc contact and forming therewith the channel for the flow of the quenching gas.

Such inserts clearly complicate the manufacture of the circuit breaker.

The arc contact systems presently known contain generally an arc contact, e.g. the stationary arc contact, shaped as a solid or hollow cylindrical finger, and the other arc contact, e.g., the movable arc contact, shaped as a tulip, with single fingers which may be either independent, or made by means of a plurality of longitudinal cuts on a hollow cylindrical body. In the first case, i.e. in the solution with independent fingers, the manufacture is very complex due to the need of providing, for each single finger, a compression spring and a suitable housing, capable of keeping in position said springs which distribute the loads on the contact fingers, said housing having also the function of preventing a disordered dispersion of the extinguishing gas in a zone in which it does not act on the arc, that is to say between a contact finger and the finger adjacent thereto. Moreover, in this case each finger must be provided with coatings of arc-resistant material. The efficiency of this solution is based on the fact that the arc be limited within a very reduced zone of the arc contacts, whilst the experience demonstrates that the presence of the gaseous stream of the quenching blast tends to shift the roots of the arc towards areas not protected with arc-resistant material, with a consequent fast consumption of the contacts. This causes in the long run the inefficiency of the system of arc contacts, and the consequent appearance of the arc on the main contacts of the circuit breaker, placed in parallel to the arc contacts, on which main contacts the quenching action by a blast of extinguishing gas being not provided for.

The solution using fingers produced by means of longitudinal cuts on a hollow cylindrical body, on the contrary, even if it is simpler than the first solution, requires always suitable protective means of insulating material to the purpose of preventing losses of quenching gas between a finger and the adjacent one, and of avoiding the action of the arc on the inner part of the fingers, which would lead to an annealing of the same, with consequent loss of resilience.

Systems of arc contacts are moreover known, so-called of proximity type, in which the contact is committed to the interaction of two surfaces theoretically not in contact with each other, but facing to each other at a very reduced distance (0.1–0.2 mm), in order to cause the formation of the arc inside this space, as soon as the separation is effected of the main contacts placed in parallel to the arc contacts. This solution is structurally simpler than those described previously, but in it the arc arises on the arc contacts as soon as the main contacts separate, due to the clearance between the same arc contacts, and such a situation lasts till to the extinguishment of the arc, so that the arc contacts are worn to a greater extent, the electrical life of the system being consequently very short.

Purpose of the present invention is therefore to provide a system of arc contacts which allows, without resorting to auxiliary inserts and similar devices, turbulence and discharge zones to be introduced of the gases produced by the arc, thus facilitating the circuit breaking, with a simple, sturdy and reliable structure, which requires neither contact elastic fingers, nor loading springs of the same, nor a protective housing.

In view of such a purpose, the Applicant has thought to provide an arc contact system, comprising a stationary contact and a movable contact, in particular for electrical circuit breakers of the type using an arc extinguishing fluid, characterized in that one of the arc contacts consists of a tubular cylindrical body bearing at its end destined to cooperate with the other arc contact, a hollow sleeve of arc-resistant material, and that the other arc contact consists of a substantially cylindrical rod provided with at least a central longitudinal cut suitable to render elastically yielding in the radial direction said rod destined to be slidingly inserted inside the tubular cylindrical body of said first arc contact. The substantially cylindrical rod which forms the second contact of said arc contact system according to the invention may be either solid or hollow.

In order to adjust and suitably pre-determine the elastic straddle of the sectors of said rod generated by the longitudinal cut, an adjustment set screw can be advantageously provided screwed in one sector, and acting with its point against the other sector.

Preferably at the root of the longitudinal cut of said rod, the section of said cut can be modified by means of a through-bore, the choice of the diameter of said bore, which modifies the elasticity of the two sectors of the rod, and hence the contact load in relation to the adjustment condition of the adjustment set screw and to the size of the cut, allowing the load on the contact point between the two stationary and movable arc contacts to be adjusted at predetermined values.

It is moreover possible to impart to the outer surface of said rod a certain conicalness, which is to be selected in function of the length linked to the presence of the longitudinal cut and of the adjustment set screw, a greater possibility being thus obtained a priori, in the stage of dimensional calibration of the rod-shaped contact, of compensation of the unavoidable wear of the inner surface of the hollow sleeve of the other contact, caused by the shifting of the arc along said surface.

The longitudinal cut with which the rod-shaped arc contact is provided, thanks to the consequent presence of edges on the surface of the two sectors of the rod, contributes, above all towards the end of the arc contact opening stroke, to introduce a stream of quenching gas directed longitudinally and transversally relatively to the nozzle which surrounds the two arc contacts and hence relatively to the arc, such as to produce turbulence regions which favour the quenching of the same arc.

In the early stage of the arc contact opening movement, the presence of the longitudinal cut in the rod-shaped arc contact causes a certain degree of dispersion of the compressed extinguishment gas through the initial length of the same cut, corresponding to the constant section of the exit port of the blast duct through which said gas is destined to act on the arc. Said port however can be reduced to a minimum value, in harmony with the surrounding geometry, so as not to compromise the correct constitution of the necessary pressure generated by the movement of the piston, know per se, solid with the movable arc contact.

Figure 2:
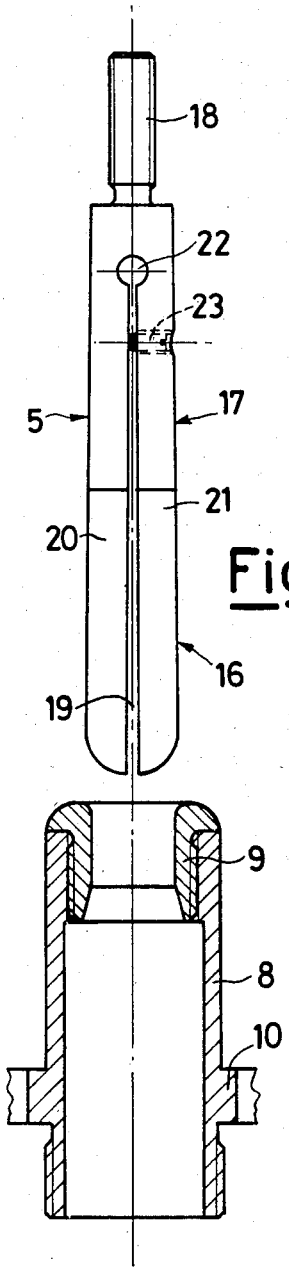
Figure 4:
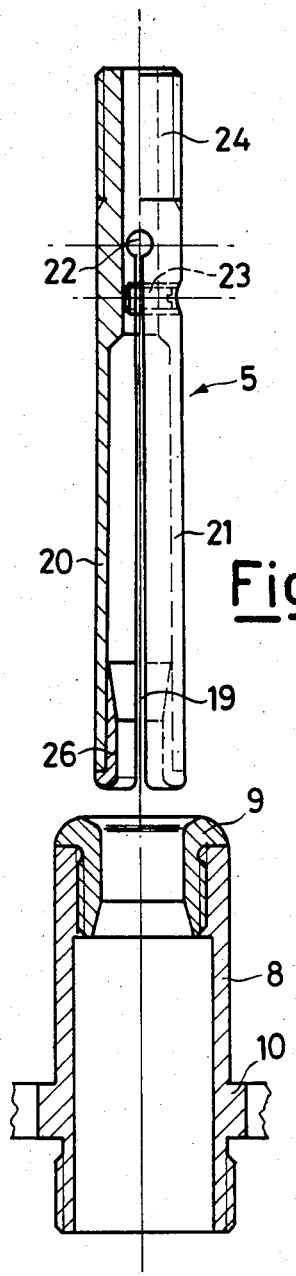
Figure 3:
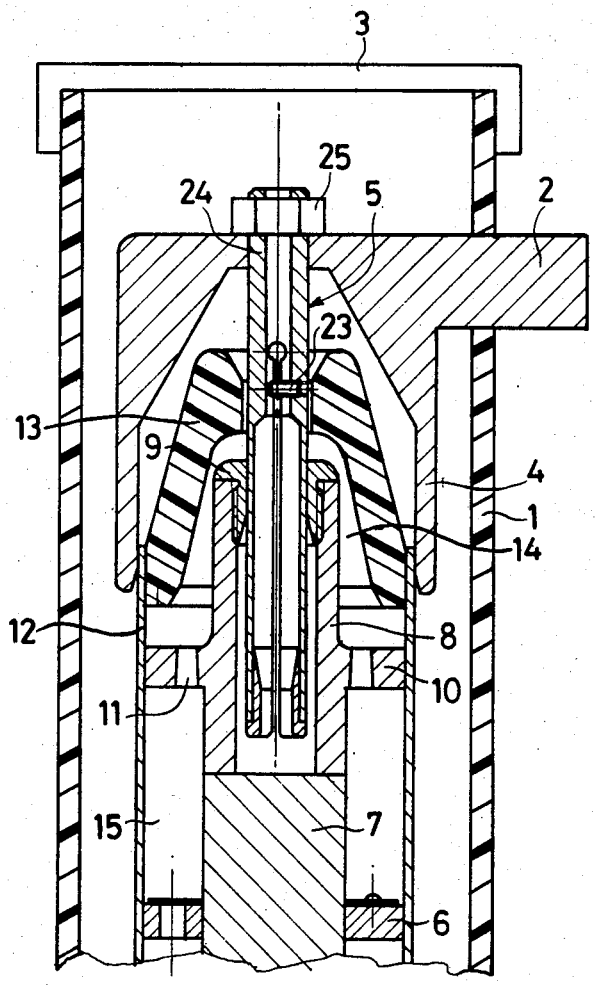

The characteristics according to the present invention are being described in more detail hereinunder with reference to the drawings enclosed, in which:

FIG. 1 shows schematically in axial section, a portion of a pole of an electrical circuit breaker, incorporating the arc contact system according to the invention, FIG. 2 shows in enlarged scale, and partly in section, the arc contact system only, and FIGS. 3 and 4 show a different embodiment, in a way similar to FIGS. 1 and 2.

It must be observed that the pole of electrical circuit breaker, wherein the arc contact system according to the invention is incorporated, is shown only in its main parts, and it must be understood that it may be realized according to well known techniques in the art.

With reference to FIGS. 1 and 3, the circuit breaker pole is formed by an insulating housing 1, shown only partly, pressurized-gas-tight. In the case of FIG. 1, the housing 1 is closed in its upper part by the upper connector 2, whilst in the case of FIG. 3, it extends beyond said connection 2 and is closed by a cover 3. The connection 2 supports the main stationary contacts 4 and at the centre of the connection 2 the stationary rod-shaped arc contact 5 is fastened.

In the lower part of the housing 1 a stationary plate 6 is provided, supported in a not shown way concentrically to the housing, and in a central through-bore of this plate, a stem 7 is slidingly guided, bearing in its upper part a tubular body 8, which is provided at its top end with a sleeve 9 of arc resistant material, forming the movable arc contact. Solid with the tubular body 8 is an external flange 10 provided with throughbores 11, to which flange 10 a cylindrical body 12 is fixed in its turn, forming the movable main contact. The cylindrical body 12 bears in its upper part a nozzle 13 of insulating material, which surrounds the tubular body 8 and the sleeve 9, forming therewith a gas passage duct 14, and which allows, through its central opening, the passage of the rod-shaped arc contact 5 when the stem 7 with the parts solid therewith move towards their contact closing position (shown in FIGS. 1 and 3).

The cylindrical body 12 with the stem 7 and the tubular body 8 define an annular chamber 15 defined upwards by the external flange 10 of the tubular body 8 and downwards by the stationary plate 6 and within this chamber the extinguishing gas which fills all the housing 1 is compressed during the contact opening movement due to the approaching of the flange 10 to the stationary plate 6.

The compressed gas can escape from the chamber 15 and enter the duct 14 through the bores 11, from which duct in its turn the compressed gas escapes in the form of a gas blast, when the movable arc contact (sleeve 9) separates from the stationary arc contact 5, for carrying out the quenching of the arc which is formed between the said two arc contacts.

The arc contact system according to the invention is shown in particular in FIGS. 2 and 4.

From these figures it may be in particular observed that the sleeve 9 of arc resistant material and forming the movable arc contact is screwed in the top end of the tubular body 8 by means an external thread thereof, which is screwed in an internal thread of the body 8. The sleeve 9 covers completely the free end of the tubular body, and covers partly its internal bore.

The stationary arc contact 5 is formed in the case of FIGS. 1 and 2 by a solid rod, which in its end part 16 is made of arc resistant material, and in its residual part 17 is formed of copper-beryllium or copper-chromium. Said rod ends upwards in a threaded pin 18, for it to be fastened by means of screwing in the connection 2 (FIG. 1). The rod 5 has a central longitudinal cut 19 of suitable size, which divides the same rod in two arms or sectors 20, 21, and which ends at its root in a through-bore 22 transversely passing through the rod. This bore 22 allows, by properly selecting the diameter thereof, the contact load to be adjusted a priori at a desired value, obtained by means of the bending of the two rod sectors 20, 21, when they are inserted inside the sleeve 9, in that said bore modifies the elastic characteristic of the two arms or sectors. It should be noted that the end part 16 made of arc resistant material is not interested by the bending, in that the function of bending, determining the contact load, is entrusted to the residual part 17 made of copper. The steadiness of this contact load is adjusted by means of an adjustment set screw 23, screwed in the arm or sector 21, and acting with its point against the arm or sector 20 of the rod, causing the two arms to diverge by bending, and determining the distance between the two inner walls generated by the longitudinal cut 19.

Suitably the outer surface of the stationary rod-shaped contact 5 may be of conical shape, with greater size in diameter in correspondence of its free end, which is advantageously spherically shaped.

By suitably selecting this conicalness in function of the length linked to the presence of the cut 19 and of the adjustment set screw 23, it is possible to obtain a priori in the stage of dimensional calibration of the contact a greater possibility of compensation of the unavoidable wear of the inner surface of the sleeve 9 of the movable arc contact, wear which takes place at each circuit breaking, and from which the electrical life (number of cumulated circuit breaking manoeuvres) of the contact system depends.

The size of the longitudinal cut 19 is to be proportioned with the size of the discharge section of the blast duct 14 between the sleeve 9 of the movable arc contact and the nozzle 13 solid therewith, so as to compensate by means of the reduction of the diameter of the nozzle the discharge section introduced by the section of the cut in the stationary arc contact. The presence of the longitudinal cut 19 in the stationary arc contact is indeed, in the early stage of the opening movement, an element which tends to disperse some compressed gas through the initial part of the cut, correspondingly to the constant discharge port of the blast duct. This discharge port however can be reduced to the minimum value in harmony with the surrounding geometry, so as not to compromise the correct generating of the pressure inside the compression chamber 15.

Mainly towards the end of the opening stroke, the cut 19 helps in introducing a longitudinal and transversal flow in the sense of the nozzle (upwards in FIGS. 1 and 3) and hence of the arc, such as to generate turbulence and discharge regions of the gases produced by the arc, which facilitate the extinguishment of the same arc.

The variant shown in FIGS. 3 and 4 is different to the embodiment disclosed, only in that the stationary rod-shaped arc contact 5 is hollow instead of being solid, and that it is fastened by means of a threaded tang 24 thereof and of a nut 25 in a central bore of the connection 2. The end part of the hollow rod 5 bears an arc resistant sleeve 26. This variant allows the discharge section to be largely increased of the gases produced by the arc in the direction of the stationary arc contact, making flow these gases in a zone inside the housing between the upper connection 2 and the cover 3 (FIG. 3).

The arc contact system provided according to the invention allows therefore the arc quenching conditions to be improved, thanks to the generation of turbulence regions of the extinguishing gas due to the presence of the longitudinal cut in the stationary rod shaped arc contact, it being not necessary to resort to this purpose to suitable elements inserted inside the duct through which the extinguishing gas flows.

Moreover, thanks to the fact of having made flexible the stationary arc contact, and rigid the movable one, a noticeable structural simplifying has been obtained, the usual fingers forming the movable arc contact having been eliminated, together with their related springs and protective housing. The unavoidable wear caused by the shift of the arc along the inner surface of the arc resistant sleeve is compensated for by the elastic action of the stationary arc contact, which can be suitably determined a priori in the stage of calibration, and adjusted by means of the adjustment grub screw, so as to obtain a constant contact load of predetermined value.

I claim:

1. An arc contact system for electrical circuit breakers, particularly of the type using an arc extinguishing fluid, comprising a stationary elongated generally cylindrical stationary contact of a predetermined exterior circumference and a movable tubular contact of an interior circumference corresponding generally to said exterior circumference; means mounting said contacts for relative sliding telescopic movement between a first position at which said stationary contact is inserted within said movable contact a predetermined maximum axial extent, a second position at which said contacts are axially spaced from each other and at least a third intermediate position between the first and second positions at which said stationary contact is within said movable contact at an axial distance less than said predetermined maximum axial extent; a nozzle in spaced surrounding relationship to said movable tubular contact and said stationary contact at least in said first and third positions and defining therewith a generally annular gas chamber, an opening in said nozzle coaxial with and spaced from an end portion of said movable tubular contact through which said stationary contact passes, said movable tubular contact end portion carrying arc resistant material, and passage means formed along said stationary contact extending from a free end portion thereof for an axial length greater than said third intermediate position distance for dispersing compressed gas, prior to said contacts reaching said second position upon relative movement from said first position and while said stationary contact is within said nozzle opening, from said annular gas chamber through said passage means beyond said nozzle.

2. The arc contact system as defined in claim 1 wherein said passage means is an axial slot.

3. The arc contact system as defined in claim 1 wherein said passage means is an axial slot, and said stationary contact is generally tubular at least in the area of said axial slot.

4. The arc contact system as defined in claim 1 wherein said passage means sets-off a pair of spaced legs of said stationary contact, and said stationary contact includes means for imparting predetermined radial flexibility to said stationary contact legs.

5. The arc contact system as defined in claim 1 wherein said passage means sets-off a pair of spaced legs of said stationary contact, said stationary contact includes means for imparting predetermined radial flexibility to said stationary contact legs, and said flexibility imparting means includes a radial enlarged opening at a terminal end portion of said passage means.

6. The arc contact system as defined in claim 1 wherein said passage means sets-off a pair of spaced legs of said stationary contact, and means for selectively adjusting the distance between said stationary contact legs thereby selectively varying the relative flexibility thereof.

7. The arc contact system as defined in claim 1 wherein said passage means sets-off a pair of spaced legs of said stationary contact, means for selectively adjusting the distance between said stationary contact legs thereby selectively varying the relative flexibility thereof, and said selective adjusting means being effective for selectively varying the distance between said pair of stationary contact legs.

8. The arc contact system as defined in claim 7 wherein said last-mentioned means is a set screw.

9. The arc contact system as defined in claim 2 wherein said passage means sets-off a pair of spaced legs of said stationary contact, and means for selectively adjusting the distance between said stationary contact legs thereby selectively varying the relative flexibility thereof.

10. The arc contact system as defined in claim 3 wherein said passage means sets-off a pair of spaced legs of said stationary contact, and means for selectively adjusting the distance between said stationary contact legs thereby selectively varying the relative flexibility thereof.

11. The arc contact system as defined in claim 4 wherein said passage means sets-off a pair of spaced legs of said stationary contact, and means for selectively adjusting the distance between said stationary contact legs thereby selectively varying the relative flexibility thereof.

* * * * *